US012655624B2

(12) United States Patent
Laue et al.

(10) Patent No.: US 12,655,624 B2
(45) Date of Patent: Jun. 16, 2026

(54) COLLAPSIBLE STRUCTURE COMPLEXING SYSTEMS AND METHODS

(71) Applicant: trac9, LLC, Huntsville, AL (US)

(72) Inventors: Greg B. Laue, Huntsville, AL (US); Timothy J. Wright, Huntsville, AL (US); John David Madagan, Athens, AL (US); Kevin Nelson Overton, Huntsville, AL (US)

(73) Assignee: trac9, LLC, Huntsville, AL (US)

( * ) Notice: Subject to any disclaimer, the term of this patent is extended or adjusted under 35 U.S.C. 154(b) by 498 days.

(21) Appl. No.: 18/200,339

(22) Filed: May 22, 2023

(65) Prior Publication Data

US 2023/0374773 A1 Nov. 23, 2023

Related U.S. Application Data

(60) Provisional application No. 63/344,178, filed on May 20, 2022.

(51) Int. Cl.
*E04B 1/344* (2006.01)

(52) U.S. Cl.
CPC ..... *E04B 1/344* (2013.01)

(58) Field of Classification Search
CPC ..... E04H 15/008; E04H 15/36; E04B 1/3345; E04B 1/3347
USPC ..... 135/128, 143
See application file for complete search history.

(56) References Cited

U.S. PATENT DOCUMENTS

| | | | | |
|---|---|---|---|---|
| 2,982,290 | A * | 5/1961 | Hunziker | E04H 15/00 52/81.1 |
| 4,118,901 | A * | 10/1978 | Johnson | E04B 1/345 52/18 |
| 4,467,572 | A * | 8/1984 | Somers | A63H 33/008 16/225 |
| 4,649,947 | A * | 3/1987 | Tury | E04H 15/644 135/117 |
| 10,024,076 | B1 * | 7/2018 | Hamm | E04H 15/008 |
| 2005/0108955 | A1 * | 5/2005 | Howe | E04H 1/1205 52/79.5 |
| 2020/0040599 | A1 * | 2/2020 | Laue | E04B 1/345 |

OTHER PUBLICATIONS

International Preliminary Report on Patentability for International application serial No. PCT/US2022/024064 mailed Dec. 21, 2023.

* cited by examiner

*Primary Examiner* — Daniel J Troy
(74) *Attorney, Agent, or Firm* — Bradley Arant Boult Cummings LLP; Alex H. Huffstutter

(57) ABSTRACT

A collapsible structure system can have a plurality of collapsible shelters connected via one or more cross tunnels. The cross tunnel may allow users to move between the first shelter and second shelter without going outside of the collapsible structure system.

17 Claims, 15 Drawing Sheets

COLLAPSIBLE STRUCTURE COMPLEXING SYSTEMS AND METHODS

CROSS-REFERENCE TO RELATED APPLICATIONS

This application claims priority to U.S. Provisional Patent Application Ser. No. 63/344,178, filed May 20, 2022 and entitled "Collapsible Structure Complexing Systems and Methods," which is incorporated herein by reference in its entirety.

BACKGROUND

Portable, collapsible structures capable of being shipped in compact configurations and which can maintain structural integrity when erected and which may be rigid over an enclosed volume are desirable. Frequently, multiple such collapsible structures may be used together. It may be beneficial to connect two adjacent collapsible structures to create a system, so that personnel can move between structures without exiting the interior of the collapsible structure system. It also may be beneficial to create additional access points to allow users to more easily enter or exit a collapsible structure. Further, it may be beneficial to divide such structures internally for compartmentalization.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

Figure 1:
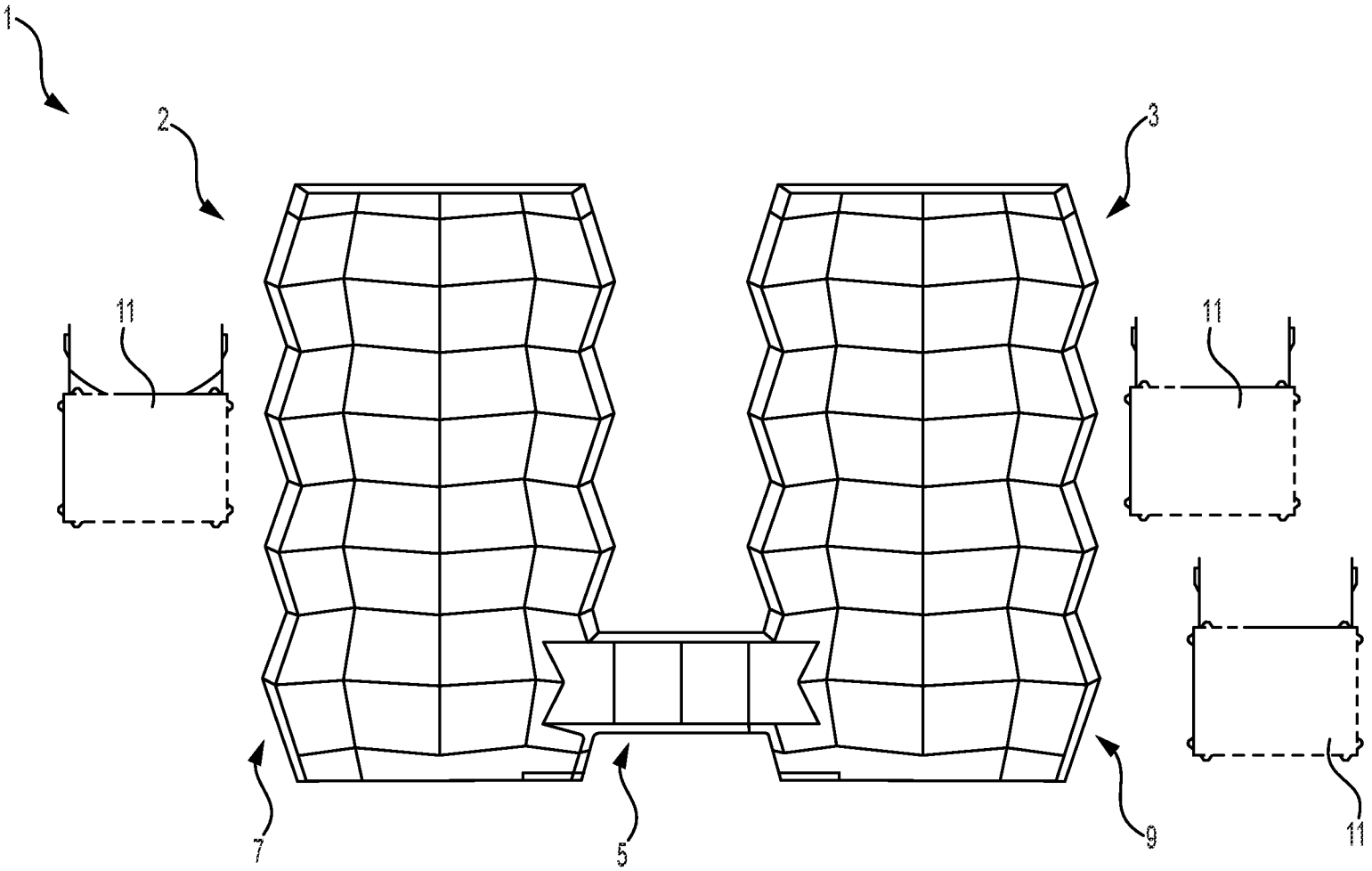
FIG. 1 is a top view of a cross tunnel system connecting two collapsible structures of a collapsible structure system in accordance with some embodiments of the present disclosure.

An abstract is included herewith and incorporated herein by reference in its entirety.

1. Partial Listing of Reference Numbers

| | |
|---|---|
| collapsible structure system 1 | gasket 33 |
| first shelter 2 | latch 35 |
| second shelter 3 | side connector panel location 36 |
| cross-tunnel 5 | expandable hinge 37 |
| first arch 7 | piano hinge 39 |
| second arch 9 | threaded insert 41 |
| pallet 11 | threaded fastener 43 |
| side-entry element 12 | latch slot 45 |
| side connector panel 13 | tether 47 |
| panel top 15 | divider wall system 50 |
| door 17 | left door 52 |
| door panel 19 | right door 54 |
| cross tunnel arch 21 | left divider wall panels 56 |
| side entry element stacks 23, 27 | left divider wall perimeter panels 60 |
| arch top panel 26 | top divider wall panels 62 |
| arch side panels 28 | right divider wall panels 64 |
| cross tunnel arch stack 25 | door frame 68 |
| access region 30 | divider wall stack 70 |
| complexing arch 31 | first panel of $1^{st}$ arch of panels 72 |
| breakout boundary 32 | second panel of $1^{st}$ arch of panels 74 |
| third panel of $1^{st}$ arch of panels 76 | side entry panel portion 113 |
| first panel of $2^{nd}$ arch of panels 78 | shelter panel portion 140 |
| second panel of $2^{nd}$ arch of panels 80 | |

2. Collapsible Structure Complexing Systems and Methods

A collapsible structure system 1 can have a plurality of collapsible shelters connected via one or more cross tunnels 5. FIG. 1 shows such as system 1, which has a first collapsible shelter 2 and second collapsible shelter 3. The shelters can be the same or similar to those described in U.S. patent application Ser. No. 16/530,486, now U.S. Pat. No. 10,934,736, filed Aug. 2, 2019 and entitled "Collapsible Structure," which claims the benefit of provisional patent application Ser. No. 62/714,471, filed Aug. 3, 2018, and entitled "Collapsible Structure." The disclosure of each of the foregoing is hereby incorporated herein by reference in its entirety.

In FIG. 1, a cross tunnel 5 connects a first arch 7 of the first collapsible shelter 2 with a second arch 9 of the second collapsible shelter 3. The cross tunnel 5 may allow users to move between the first shelter 2 and second shelter 3 without going outside of the collapsible structure system 1.

Each of the cross tunnels 5 may comprise a plurality of panels and hinges, and may be configured to fold into a stack (as described further below in reference to FIG. 4) which can be placed in a pallet 11 for transportation along with one or more of the collapsible shelters 2, 3. The panels and hinges may be similar to or the same as the panels and hinges described in U.S. Pat. No. 10,934,736, filed Aug. 2, 2019 and entitled "Collapsible Structure," and may operate in the same or essentially the same manner. In some embodiments, the first arch 7 and second arch 9 are configured to transition between folded and erected states. The arches 7, 9 (and other arches of structures 2, 3) may expand into an expanded (erected) state and collapse to a collapsed (folded) state. The hinges (not specifically shown) may allow panels of the cross tunnel 5 to fold into a stack. In some embodiments, the arches 7, 9 are complexing arches such as complexing arch 31, discussed further below with regards to FIGS. 4A-4D, FIGS. 5A and 5B, and FIG. 6.

In some embodiments, a cross tunnel 5 may have additional systems implemented, such as an air shower system (not specifically shown). The cross tunnel 5 also may have a pass through. In some embodiments, an air shower or pass-through system incorporated in cross tunnel 5 may be a commercially available air shower or commercially available pass-through. Example systems include products manufactured and marketed by Air Showers and Pass Thrus Unlimited, Inc. (ASPT), such as a Tunnel Air Shower (referred to in marketing material published by ASPT as "TN model" series models), a Standard Air Shower (referred to in marketing material published by ASPT as "SD model" series models), a Low Profile Air Shower (referred to in marketing material published by ASPT as "LP model" series models), or other commercially available air showers. Example pass-throughs include a Standard Pass Thru (referred to in marketing material published by ASPT as "SP model" series models), Airlock (referred to in marketing material published by ASPT as "AL model" series models), or similar. In some embodiments, one or both of an air shower or pass-through system may be installed in the cross tunnel 5 and may be configured to allow a user to move through the tunnel 5 while preventing contamination between a first zone on a first side of the air shower or pass through (e.g., interior of first collapsible structure 2) and a second zone on a second side of the pass through (e.g., interior of second collapsible structure 3). An example use may be when the first collapsible structure 2 is configured for spraying paint with properties hazardous to users and requiring them to use protective equipment, while the second structure 3 is configured for use as an office or meeting space in which users may not use protective equipment. In this regard, the cross tunnel 5 may have specific features configured to allow the additional systems to perform desired functions, such as ducting and nozzles for an air shower or pass through system implemented in the cross tunnel 5 in some embodiments. Other systems may be implemented in the cross tunnel 5 or within interiors of a collapsible structure 2, 3, including as a paint booth or other system.

Figure 2:
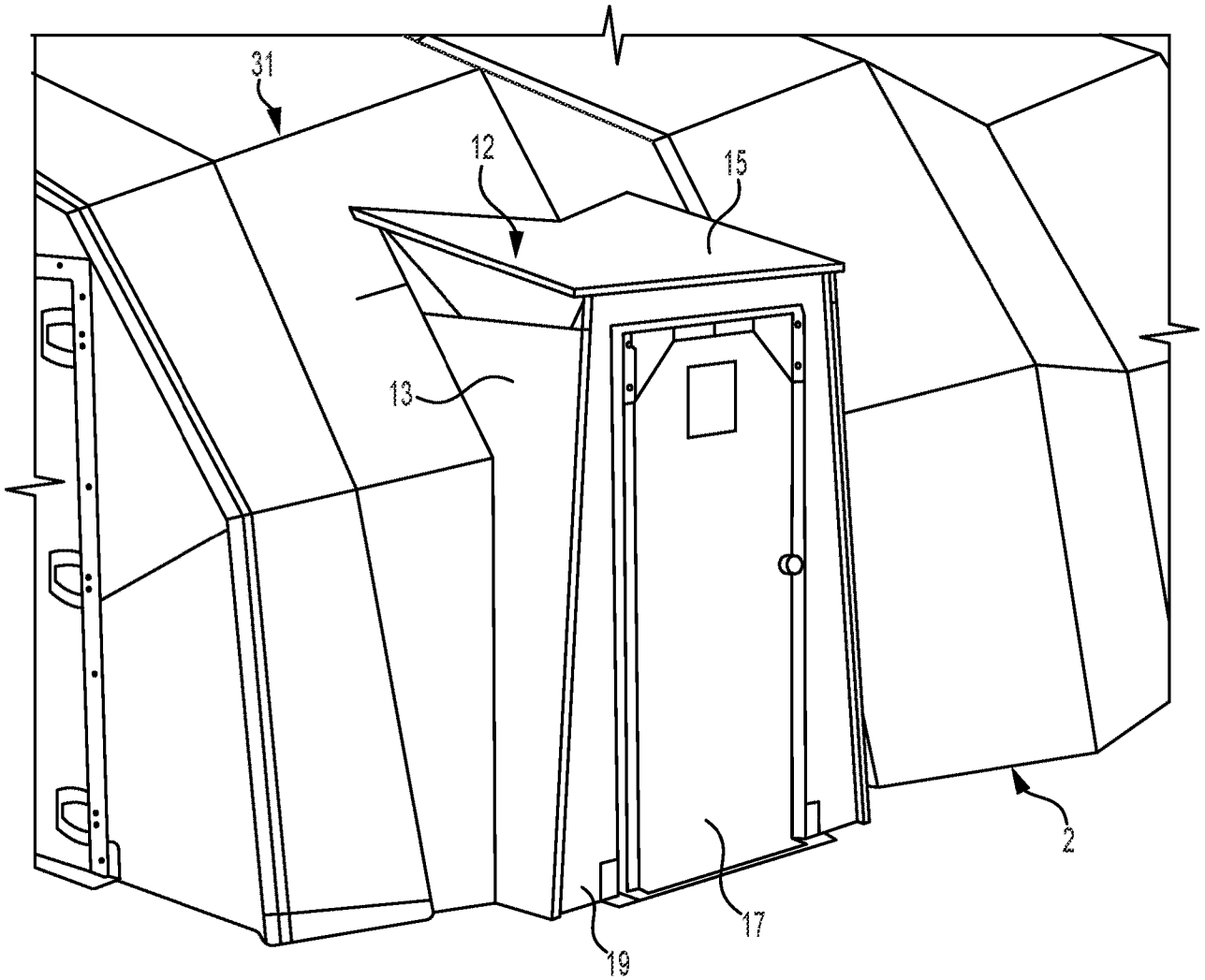
FIG. 2 is a three-dimensional front view of a side entry element of a collapsible structure system in accordance with some embodiments of the present disclosure.

A cross tunnel 5 may have various components; in some embodiments, a cross tunnel 5 may have at least one side entry element 12 as shown in FIG. 2. The side-entry element 12 may have at least one side connector panel 13, a panel top 15, and a door 17 disposed within a door panel 19. The panel top 15, side connector panels 13, door panel 19 and other components of the side-entry element 12 may be coupled together using various components, including, for example one or more of any or a combination of: a hinge; a tether; a latch; a hook and slot or ring; a pin; a fastener; a bolt; a threaded insert and threaded fastener; adhesive; and other techniques which may be apparent to one of ordinary skill upon reading the present disclosure. Such components also may couple elements of the cross tunnel 5 to one another, and may couple a side entry element 12 to one or more panels of a structure 2, 3.

To further illustrate, FIGS. 3A-3G show exemplary steps for coupling a portion of a cross tunnel 5 (e.g., side-entry element 12, and more specifically a side connector panel 13) to a panel of a structure 2, 3. One or more of a side connector panel 13, and panel top 15 (here, exemplary side connector panel portion 113 is shown and referenced hereafter for ease of demonstration, but reference to one or more panels of a side entry-element 12 and/or panel top 15 may be substituted for side connector panel portion 113 where reference is made to side connector panel portion 113) may be positioned adjacent to a panel of a structure 2, 3 (again, exemplary structure panel portion 140 is shown and referenced hereafter for ease of demonstration, but reference to one or more panels of a structure 2, 3 may be substituted for panel portion 140 where reference is made panel portion 140) and prepared for coupling together.

Note that, for convenience of the reader and enhanced perception of some embodiments of the present disclosure, the connector panel portion 113 and structure panel portion 140 are shown without additional context of their connection to other panels of side entry element 12 or panels of structure 2, 3. It will be understood that the panel portions 113, 140 may have various dimensions and configurations, including those of one or more panels of cross tunnel 5, side entry element 12, and structures 2, 3.

Figure 3A:
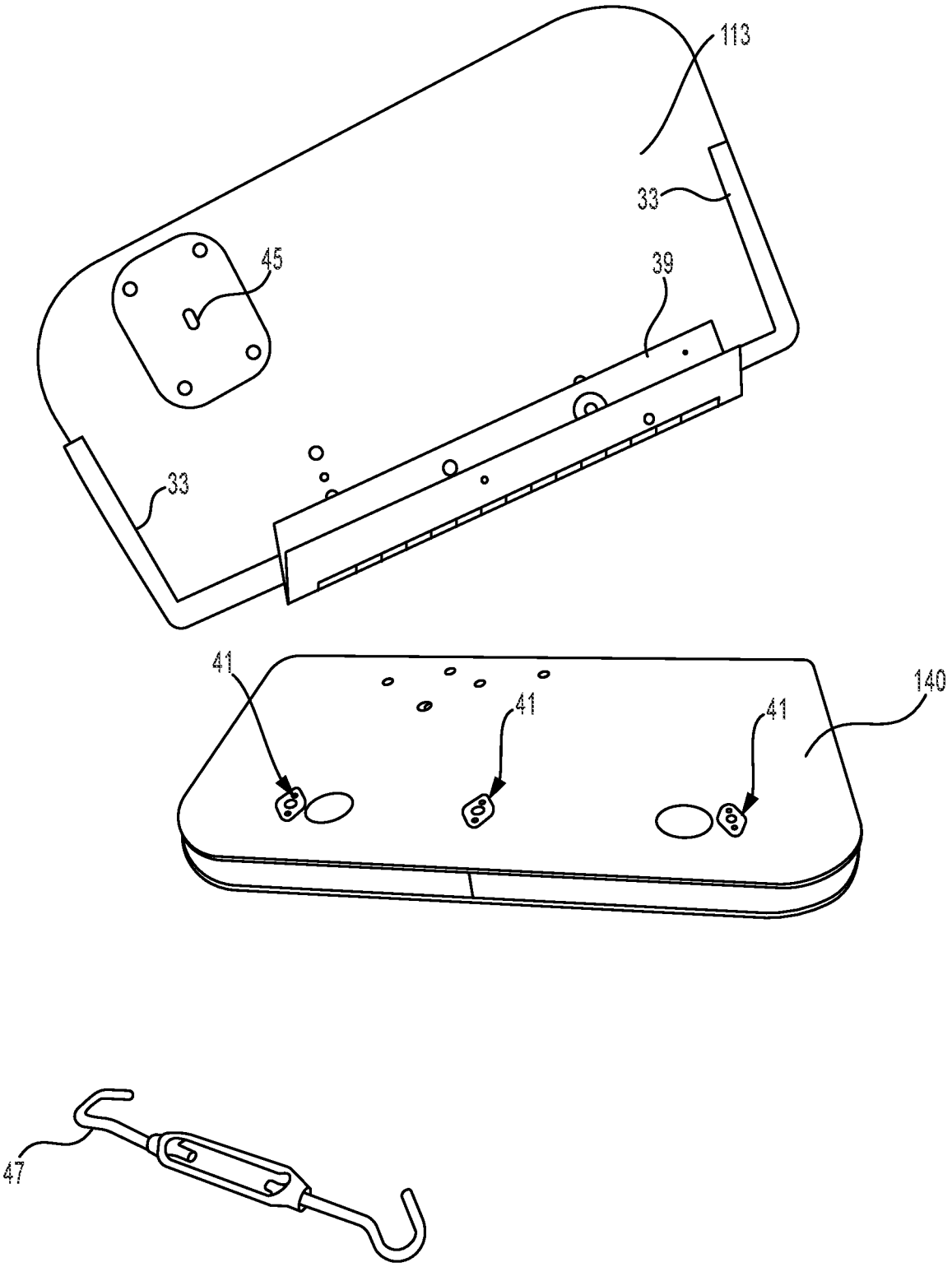
FIG. 3A depicts a step for coupling a portion of a cross tunnel panel to a panel of a structure system in accordance with some embodiments of the present disclosure.
Figure 3B:
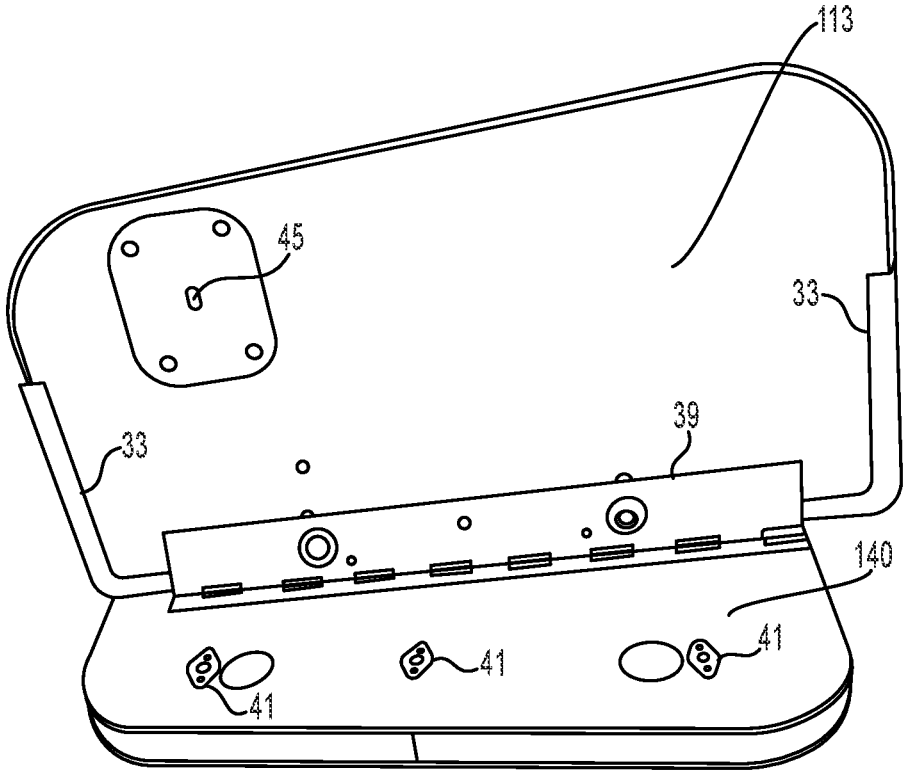
FIG. 3B depicts a step for coupling a portion of a cross tunnel panel to a panel of a structure system in accordance with some embodiments of the present disclosure.
Figure 3B:
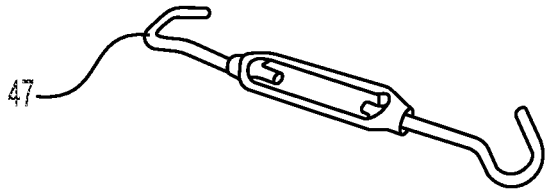
Figure 3C:
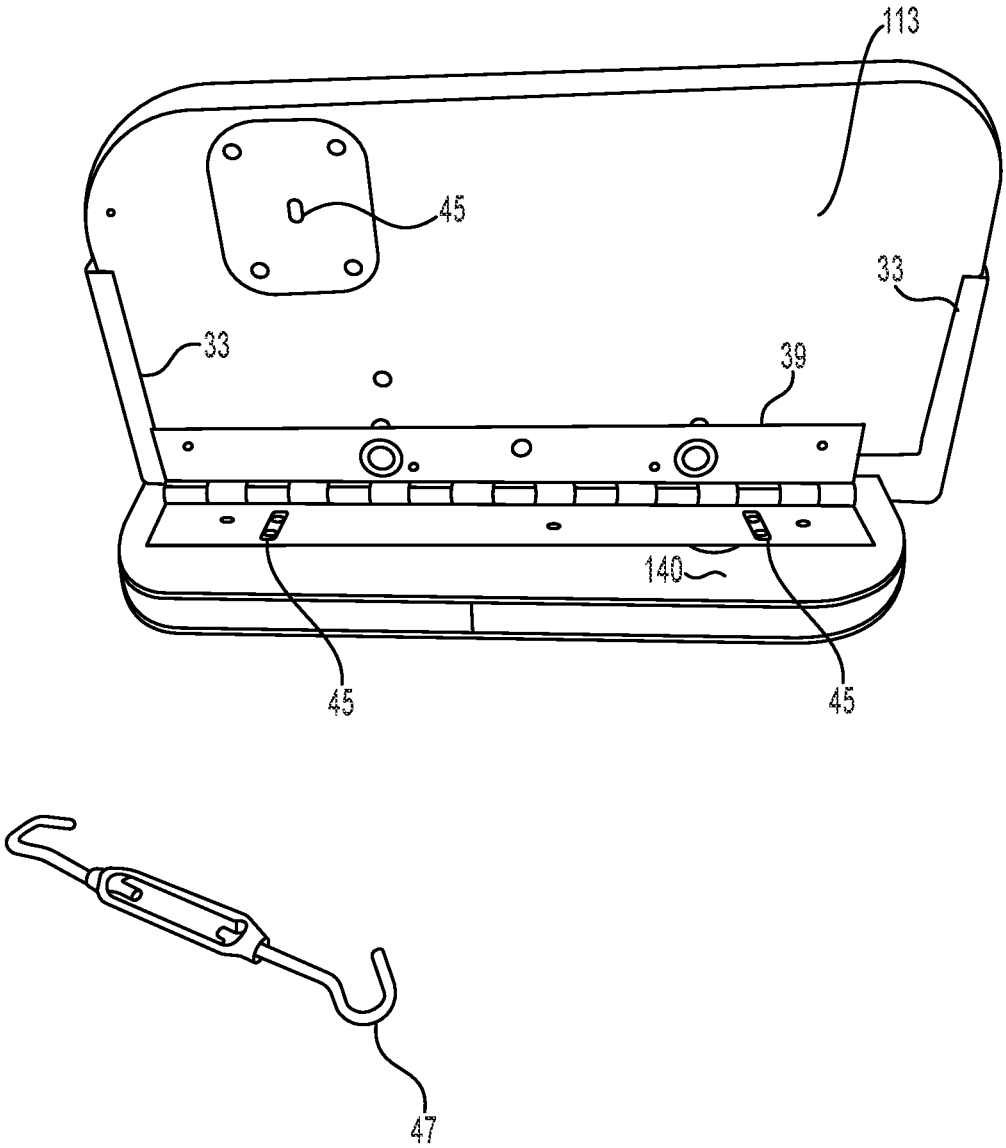
FIG. 3C depicts a step for coupling a portion of a cross tunnel panel to a panel of a structure system in accordance with some embodiments of the present disclosure.

FIGS. 3A-3C demonstrate how hinge 39 may couple to a connector panel portion 113 and panel portion 140. The hinge 39 may be positioned so that a plate portion of the hinge 39 (e.g., a plate) can be coupled to each of the side connector panel portion 113 and the structure panel portion 140. As shown in the drawings, a first plate of the hinge 39 may be coupled to portion 113 and a second plate of the hinge 39 may be coupled to portion 140.

Figure 3D:
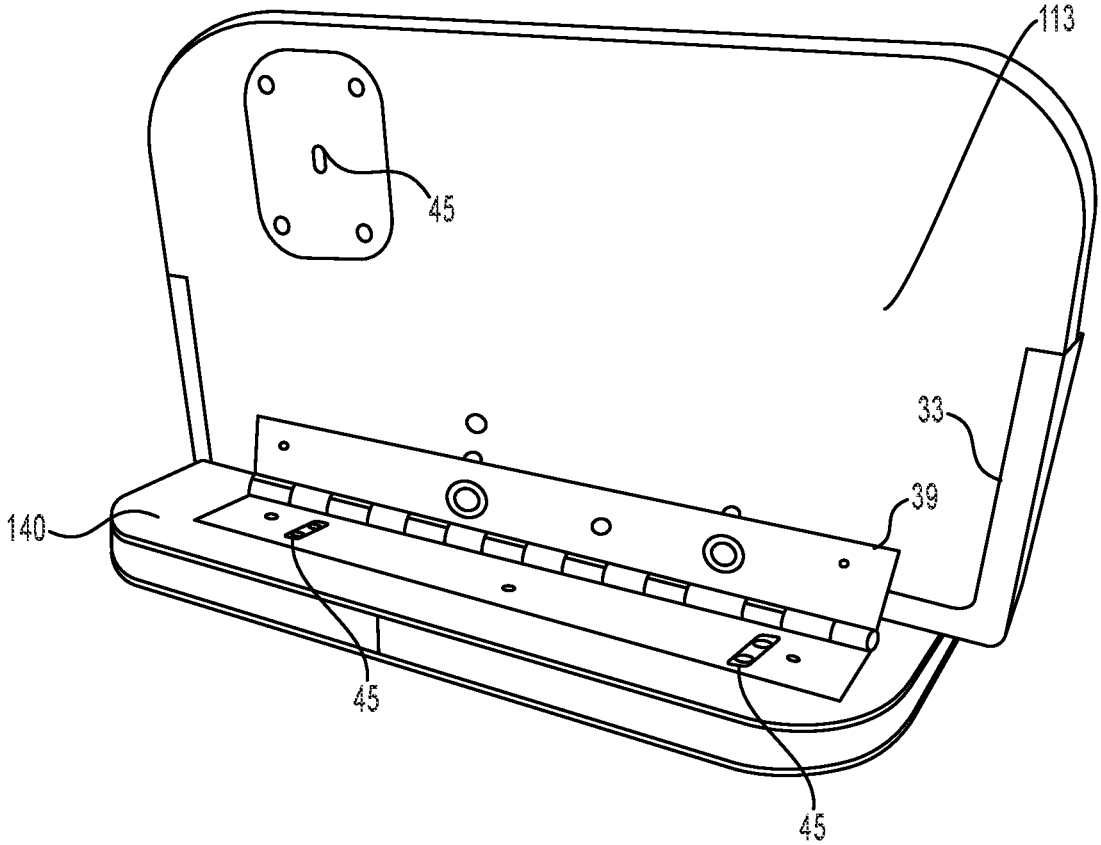
FIG. 3D depicts a step for coupling a portion of a cross tunnel panel to a panel of a structure system in accordance with some embodiments of the present disclosure.
Figure 3E:
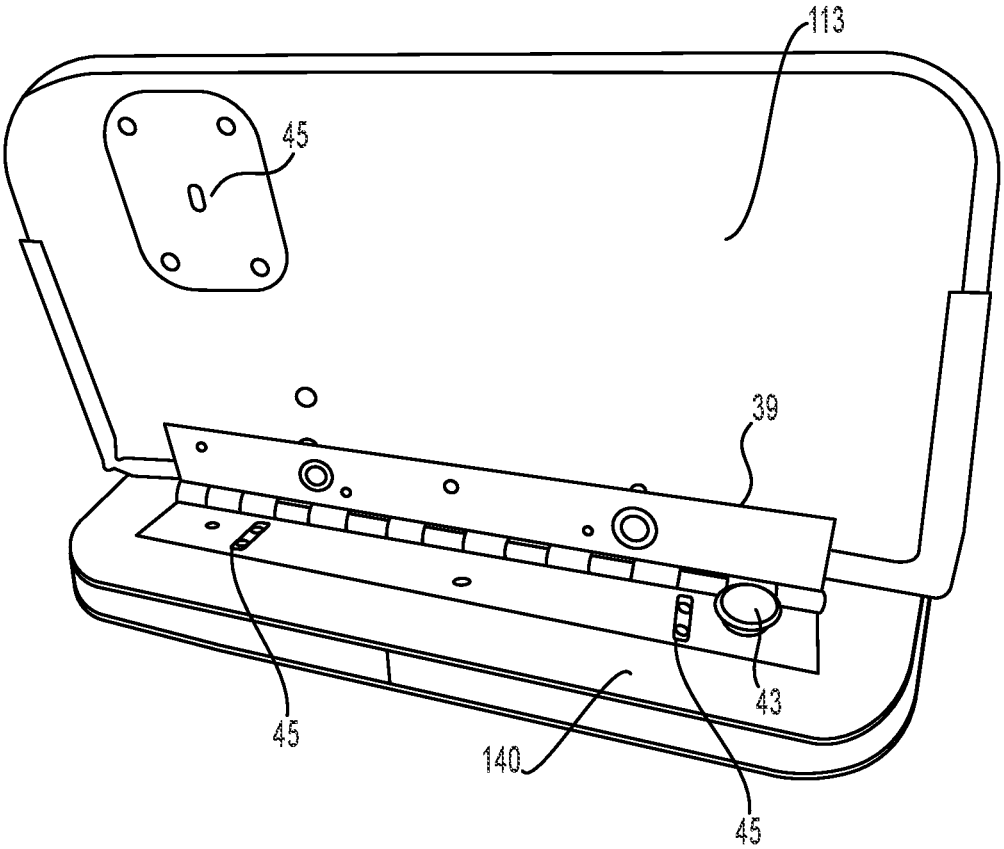
FIG. 3E depicts a step for coupling a portion of a cross tunnel panel to a panel of a structure system in accordance with some embodiments of the present disclosure.

Coupling may be performed by such as by positioning one or more apertures of the hinge plate over one or more threaded inserts 41, embedded in panel 140. As shown in FIGS. 3D, 3E, and 3G, thereafter one or more threaded fasteners 43 may be passed through apertures of the hinge plate and screwed into the threaded insert 41 to couple the hinge 39 to the panel 140. Note that the threaded fasteners 43 are bolts that can be inserted into a threaded insert 41 and hand-tightened until a desired tightness is achieved. This allows a surface of a gasket 33, positioned on an edge of the side connector portion 113, to for a seal against the panel portion 140.

Note that the structure system 1, including structures 2, 3 and respective features of cross tunnel 5, side entry element 12, may be configured to prevent ingress of particulates or other matter. In this regard, gaskets 33 may be fitted at interfaces between cross tunnel 5 and structures 2, 3 to form a complete or partial seal at the interfaces, including the constituent components of cross tunnel 5, including side entry element 12 (side-entry element 12, side connector panel 13, and panel top 15) and cross tunnel arch 21. In some embodiments, the system 1 and its components may be configured to have an ingress protection (IP) rating of IP 55 or IP 56 as defined by the International Electrotechnical Commission in Standard IEC 60529, published 1976, as amended and modified from time-to-time.

Figure 3F:
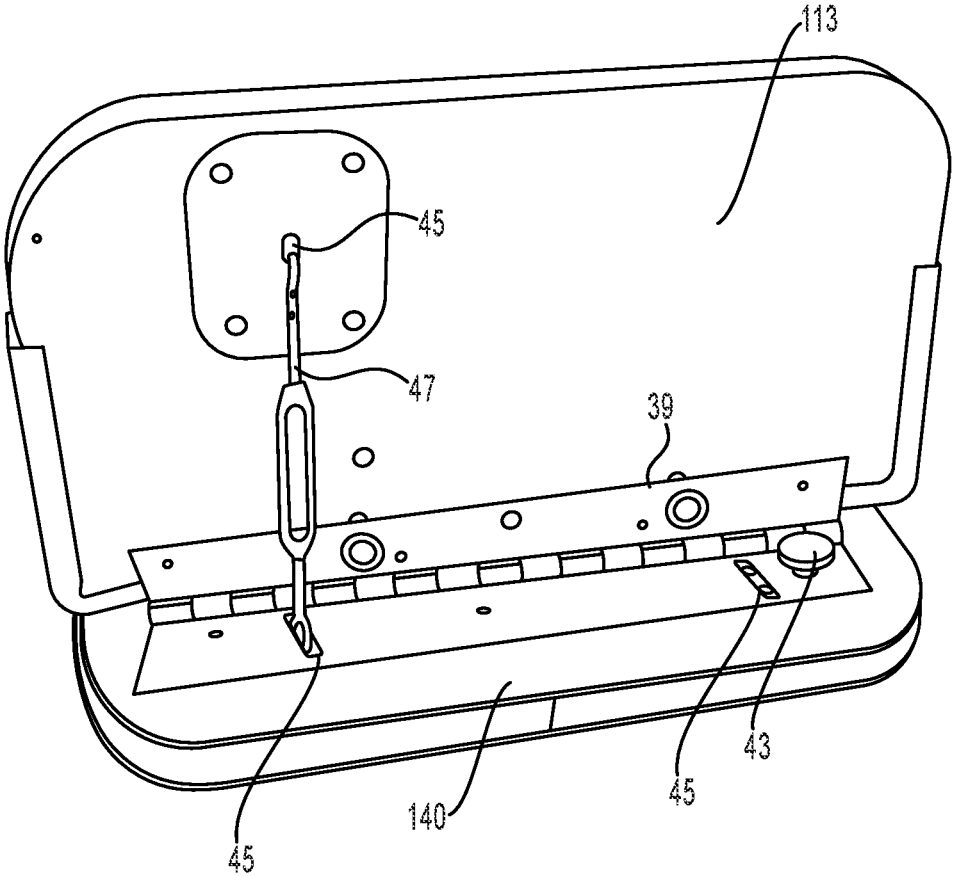
FIG. 3F depicts a step for coupling a portion of a cross tunnel panel to a panel of a structure system in accordance with some embodiments of the present disclosure.
Figure 3G:
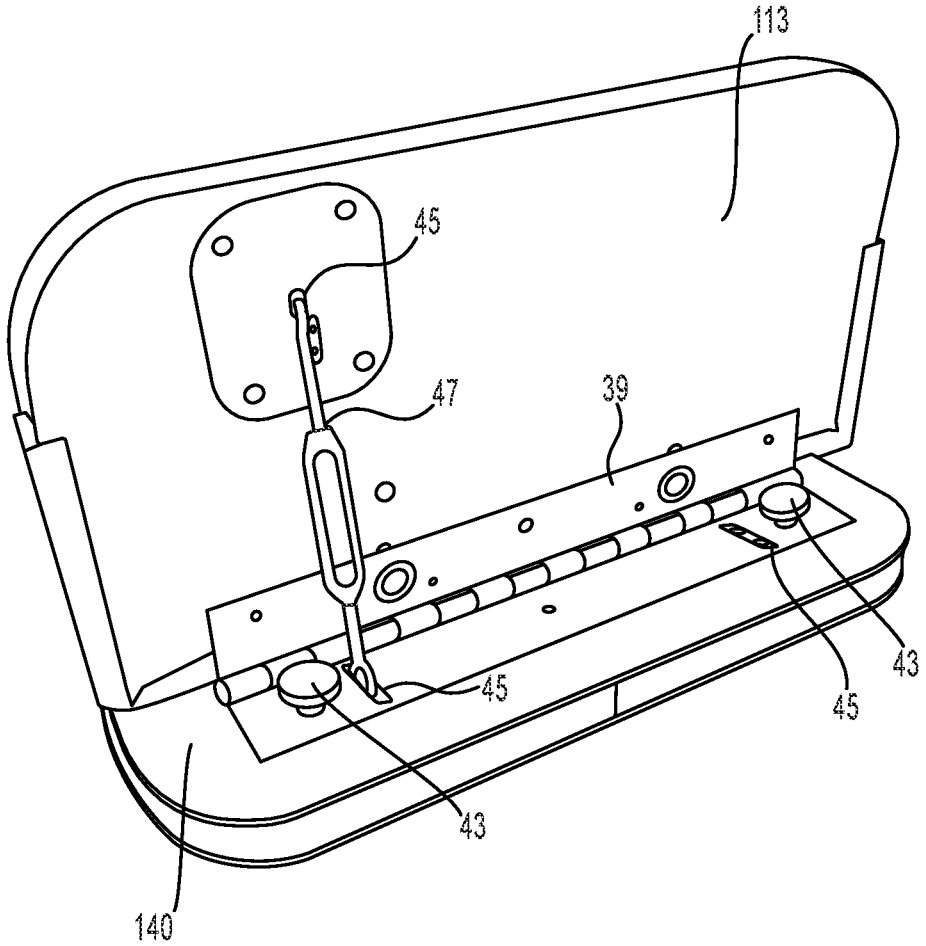
FIG. 3G depicts a step for coupling a portion of a cross tunnel panel to a panel of a structure system in accordance with some embodiments of the present disclosure.

Once the hinge 39 has been coupled to the panel portion 140, as shown in FIGS. 3F-3G, a tether 47 may be inserted into a latch slot 45 to provide additional structural support and strengthen coupling between the panel portion 140 and side connector portion 113. Latch slot 45 also may be configured to accommodate a portion of tether 47. The tether 47 in the figures has hooks on both ends and threaded portions for adjustable length. The tether 47 may have other features in other embodiments.

Note that the above coupling techniques may be implemented to couple virtually any panel of the system 1 to one or more other panels of the system 1. The above techniques are not limited to coupling of side connector panels 13 to panels of a collapsible structure 13 but can be implemented to couple together panels of the components of the cross tunnel 5 (side entry element 12, cross tunnel arch 21), and panels of each of the components of the cross tunnel 5 to one another (e.g., connector panels 13 to panel top 15 and door panel 19).

Figure 4A:
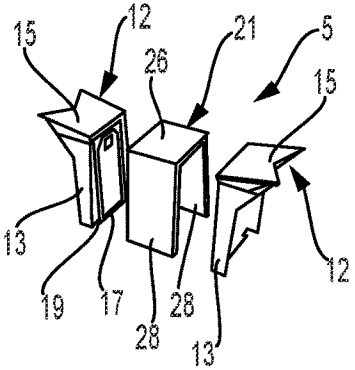
FIG. 4A is a view of elements of a cross tunnel system of a collapsible structure system in accordance with some embodiments of the present disclosure.
Figure 4B:
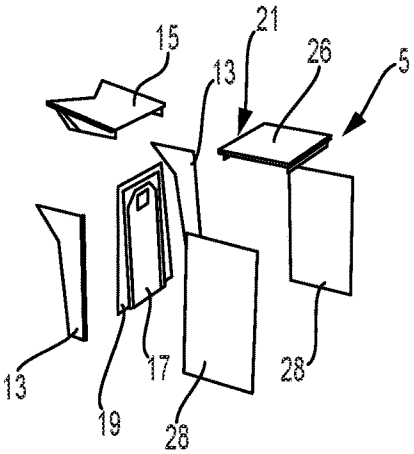
FIG. 4B is an exploded view of elements of a cross tunnel system of a collapsible structure system in accordance with some embodiments of the present disclosure.
Figure 4D:
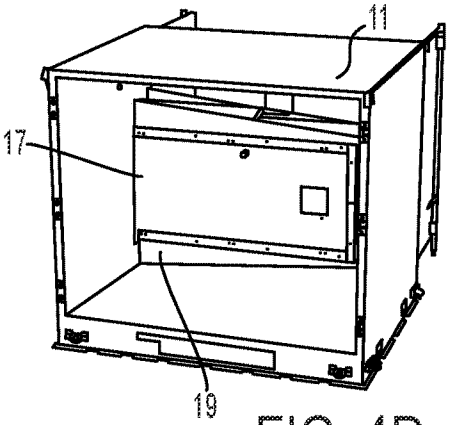
FIG. 4D depicts an exterior side view of a pallet storing elements of a cross tunnel system of a collapsible structure system in accordance with some embodiments of the present disclosure.
Figure 4C:
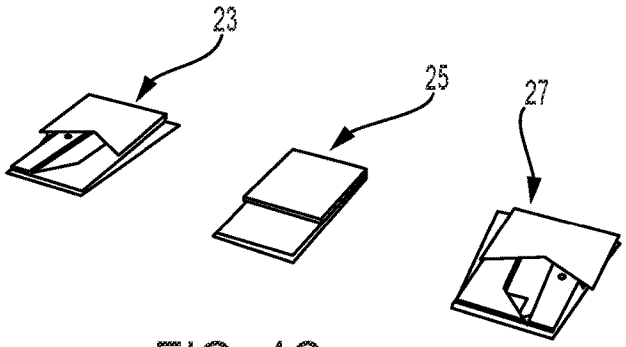
FIG. 4C depicts elements in a collapsed state of a cross tunnel system of a collapsible structure system in accordance with some embodiments of the present disclosure.

With reference now to FIGS. 4A-4E, in some embodiments, the constituent components of cross-tunnel 5 may be configured to disassemble (FIG. 4A, 4B) and fold into one or more stacks for transportation. Panels of the respective components of the cross-tunnel 5 may fold adjacent to one another via one or more hinges (FIG. 4C).

Side connector panels 13, top panel 15 and door panel 19 may decouple from one another and fold into a side entry element stack 23, 27 (FIG. 4C). Cross tunnel arch 21 may decouple from its arch top panel 26 and arch side panels 28 and fold to form a cross tunnel arch stack 25.

Figure 4E:
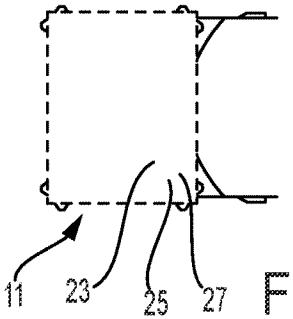
FIG. 4E depicts an exterior top view of a pallet storing elements of a cross tunnel system of a collapsible structure system in accordance with some embodiments of the present disclosure.

Thereafter, stacks 23, 25 and 27 may be loaded into a pallet 11 for transportation (FIGS. 4D and 4E). As shown in FIG. 4D, the stacks 23, 25 and 27 may be positioned so that an axis passing through edges of their respective panels are essentially orthogonal to a bottom surface of the pallet 11.

Pallet 11 shown in FIGS. 4D and 4E can be an ISU-90 or 463L pallet produced and marketed by AAR Corporation, Wood Dale, Illinois, United States, although stacks and other components of the cross tunnel 5 and associated systems may be stored in other types of pallets.

Figure 5B:
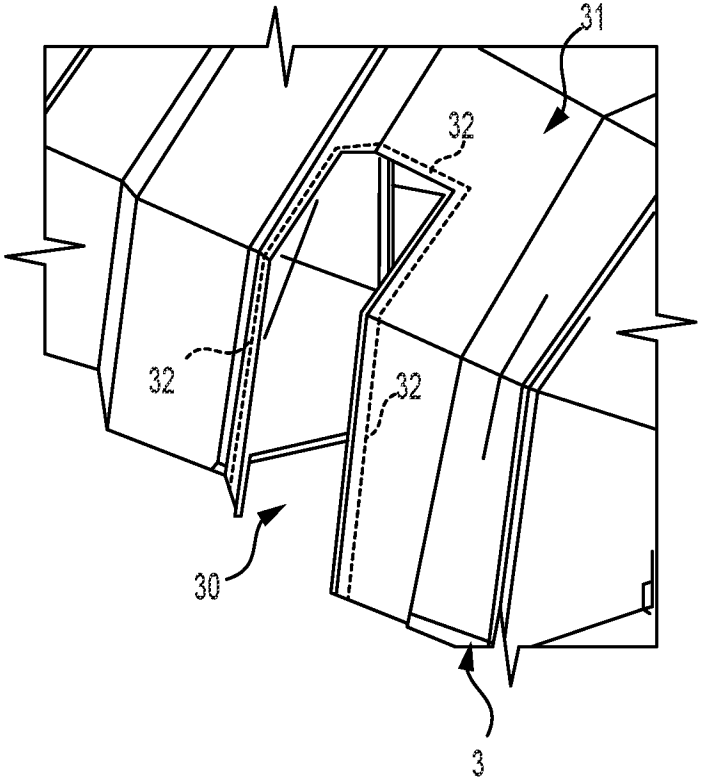
FIG. 5B shows a three-dimensional side view of an access region of a collapsible structure system in accordance with some embodiments of the present disclosure.
Figure 5A:
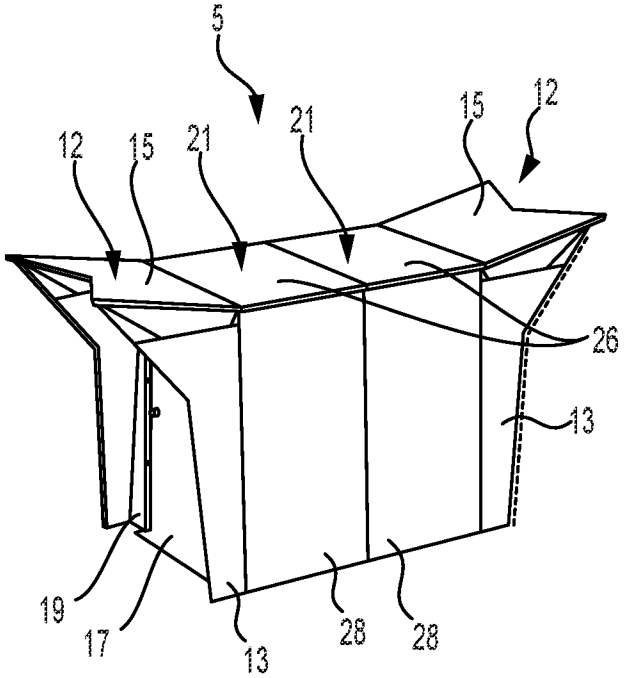
FIG. 5A shows a three-dimensional side view of a cross tunnel system of a collapsible structure system in accordance with some embodiments of the present disclosure.
Figure 6:
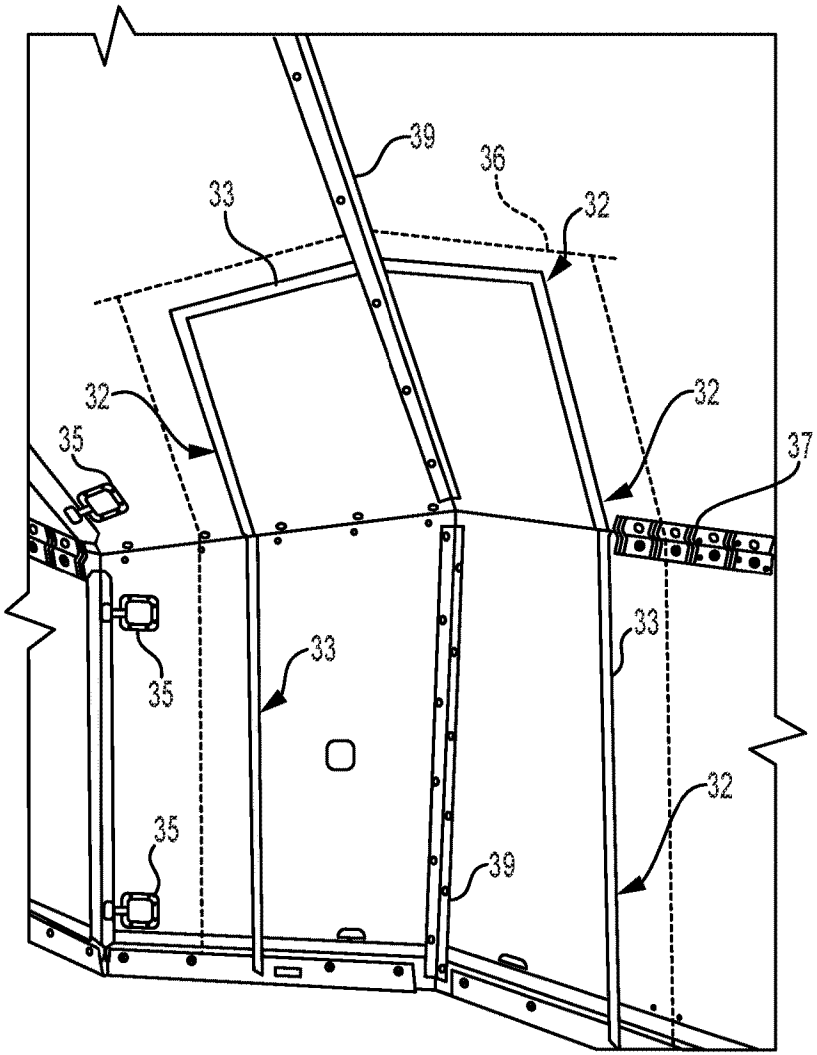
FIG. 6 shows an interior view of a complexing arch with breakout boundary intact in a collapsible structure system in accordance with some embodiments of the present disclosure.

With reference to FIGS. 5A, FIG. 5B and FIG. 6, the side-entry element 12 of cross-tunnel 5 may be positioned adjacent to a complexing arch 31 for coupling. Complexing arch 31 may be similar to other arches of a collapsible structure 2, 3, except that portions of one or more panels of the arch adjacent to the ground may have one or more portions that can be removed to create an access region 30. A breakout boundary 32 may define a removable portion of a panel of the complexing arch 31. Once portions of the panels of the complexing arch 31 at their respective breakout boundaries 32, an access region may be created to allow users to access the cross tunnel 5, side-entry element 12, or an exterior of the structure 2, 3.

Tunnel arch 21 may have arch top panel 26 and arch side panels 28, coupled together as described above and configured to form a "hallway" of cross-tunnel 5 between side entry elements 12. Essentially any number of tunnel arches 21 may be coupled to one another and to respective side entry elements 12 in order to achieve a hallway of desired length.

One or more gaskets 33 may be positioned in breakout boundary 32 between panels in order to provide ingress protection and seal between removable and non-removable portions of the panel. The breakout boundary 32 may be gasketed and reinforced for added strength so that it does not weaken its respective panels. Further, FIG. 6 shows latches 35 for coupling a panel of a first arch and a panel of a second arch to one another. A piano hinge 39 may be removed along with the portions of panels within breakout boundary 32 to create the access region 30. A plurality of hinges 37 couple panels of the first and second arches.

When use of a cross-tunnel 5, side entry element 12 or other complexing function is desired, panel portions may be removed from the complexing arch at the gasketed breakout boundary 32. When desired, the user may replace the panel portions to return the panels and structure to its previous state. The panels can be secured using various techniques described herein and in U.S. Pat. No. 10,934,736, filed Aug. 2, 2019 and entitled "Collapsible Structure." As shown in FIG. 6, a perimeter where side connector panels 13 are in contact with surfaces of structure panels may be outside of the perimeter of breakout boundary 32.

FIGS. 7A-7D, FIGS. 8A-8B and FIG. 9 show aspects of a divider wall system 50 that can be coupled to one or more interior side of panels of a structure. In this regard, the divider wall system may be configured to create a boundary, thereby dividing an interior volume of a structure 2, 3 into a plurality of rooms. The system 50 can have components that, when the divider wall is installed, effectively seal off and divide the interior volume of the structure 2, 3. As an example, a divider wall 50 may be installed where separate spaces of a structure 2, 3 may be used for different purposes or by different teams of users. The divider wall system 50 can be configured to meet requirements for various security standards promulgated by one or more organizations within the United States Department of Defense.

In addition, in some embodiments, a divider wall system 50 can be positioned at one or both ends of a structure 2, 3 to serve as a rigid end wall, thereby facilitating structure ingress and egress via an end of the structure 2, 3. The wall system 50 can be used with or without side entry 12 or cross-tunnel 5.

The divider wall system 50 can have top divider wall panels 62, left divider wall panels 56 and right divider wall panels 64. These panels can be the same or similar to panels used elsewhere on structure 2, 3 as well as cross tunnel 5 and its components. The panels of the divider wall system 50 can be coupled to hinges and can fold into a stack via techniques similar to those ascribed to other elements of the structures 2, 3 and connector tunnel 5.

Figure 7C:
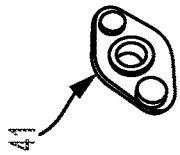
FIG. 7C shows a perspective view of threaded insert for coupling a panel of a divider wall to a panel of an interior portion of a collapsible structure system in accordance with some embodiments of the present disclosure.
Figure 7B:
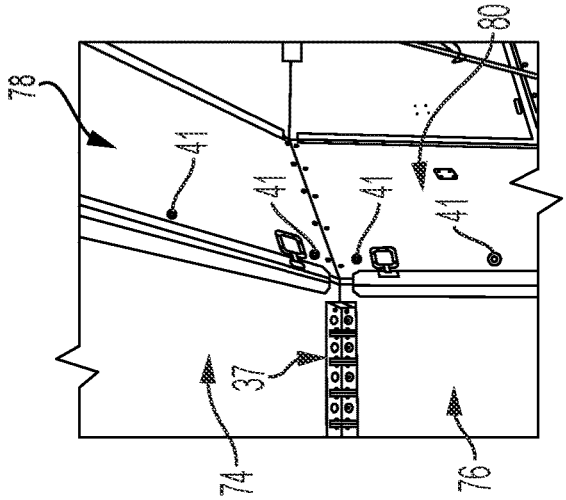
FIG. 7B shows a perspective view of a coupling surface for coupling a panel of a divider wall to a panel of an interior portion of a collapsible structure system in accordance with some embodiments of the present disclosure.
Figure 7D:
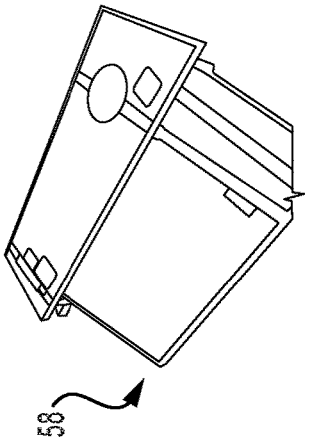
FIG. 7D shows panels of a divider wall in a collapsed state in accordance with some embodiments of the present disclosure.
Figure 7A:
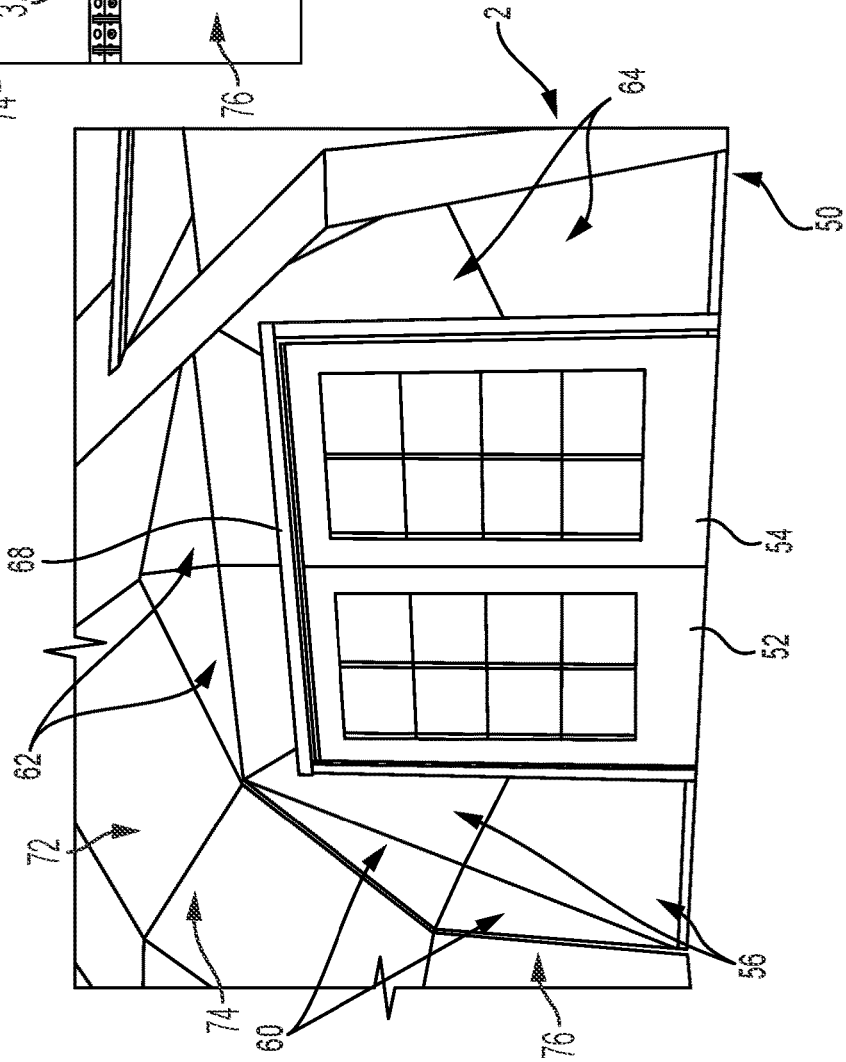
FIG. 7A shows a divider wall coupled to panels of an interior portion of a collapsible structure system in accordance with some embodiments of the present disclosure.
Figure 8B:
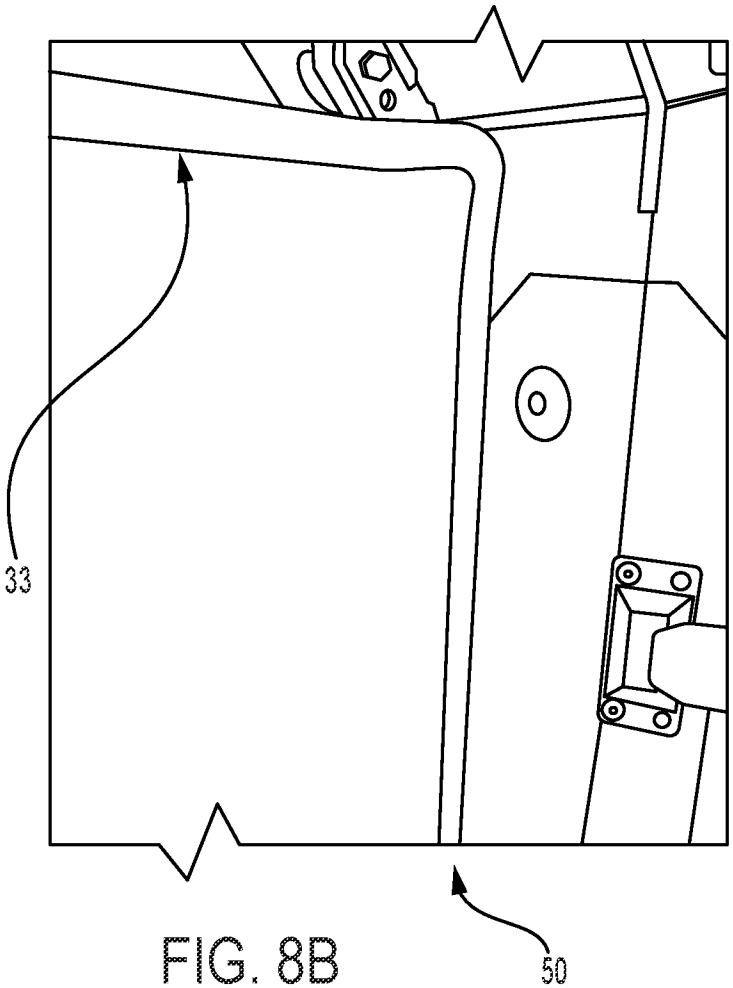
FIG. 8B shows a step for coupling a panel of a divider wall to a panel of an interior portion of a collapsible structure system in accordance with some embodiments of the present disclosure.
Figure 8A:
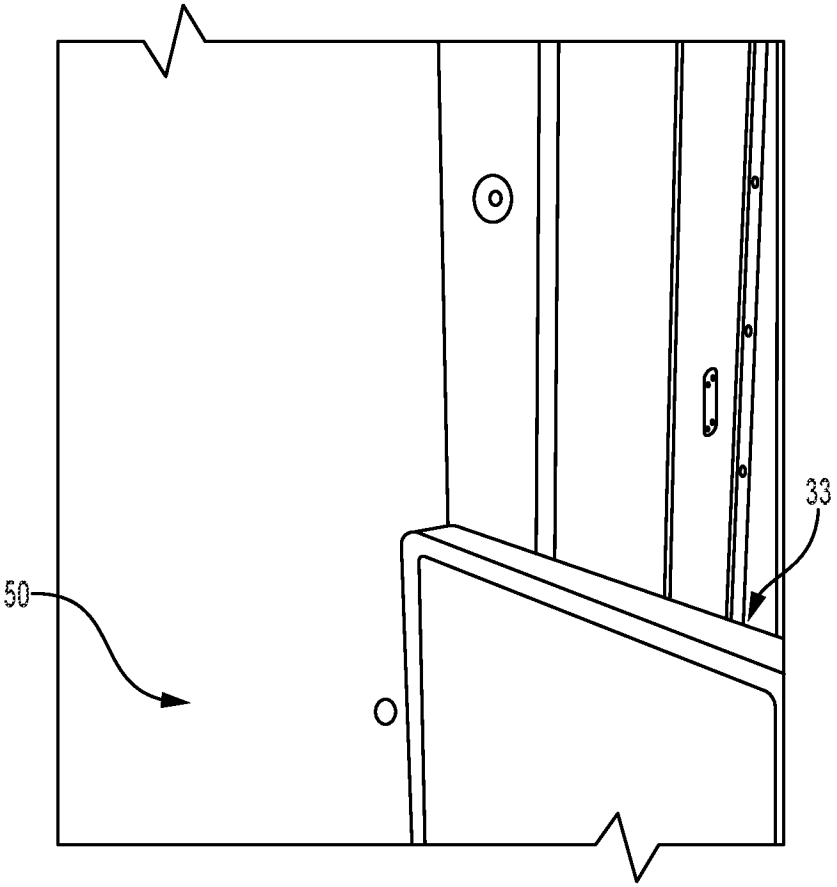
FIG. 8A shows a step for coupling a panel of a divider wall to a panel of an interior portion of a collapsible structure system in accordance with some embodiments of the present disclosure.
Figure 9C:
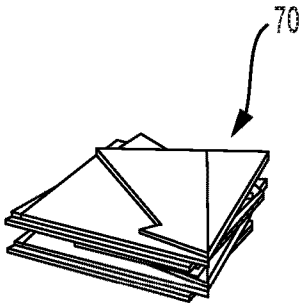
FIG. 9C shows a perspective view of a stack of folded elements of a divider wall of a collapsible structure system in accordance with some embodiments of the present disclosure.
Figure 9B:
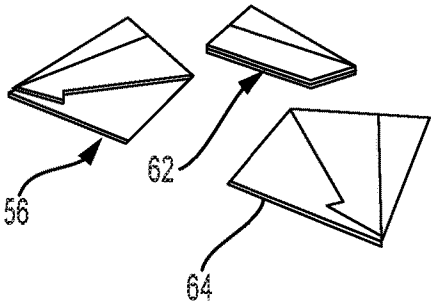
FIG. 9B shows a perspective view of folded elements of a divider wall of a collapsible structure system in accordance with some embodiments of the present disclosure.
Figure 9D:
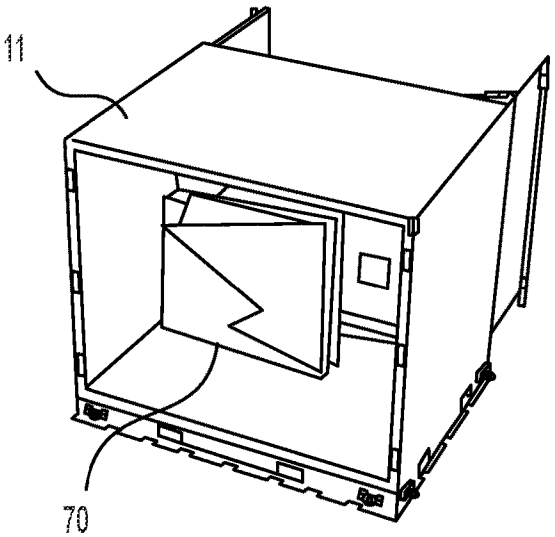
FIG. 9D shows a perspective view of pallet storing a stack of folded elements of a divider wall of a collapsible structure system in accordance with some embodiments of the present disclosure.
Figure 9A:
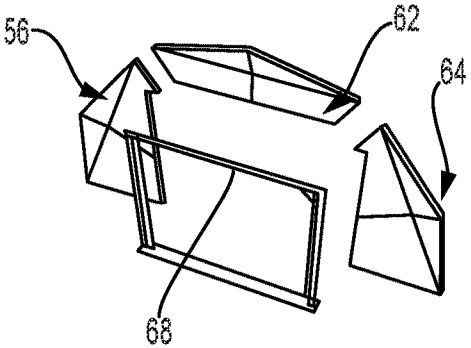
FIG. 9A shows an exploded perspective view of elements of a divider wall of a collapsible structure system in accordance with some embodiments of the present disclosure.

The divider wall system 50 may be coupled (e.g., using one or more techniques as shown in FIGS. 3A-3G) to one or more surfaces of panels of structure 2, 3. As shown in FIGS. 7A and 7B, a first top divider wall panel 62 may be coupled to a first panel 72 of a first arch of panels of a structure. A first left divider wall perimeter panel 60 may couple to second panel 74 of the first arch of panels, and a second perimeter wall divider panel 60 may couple to third panel 76 of the first arch of panels. Right divider wall perimeter panels (not specifically shown in FIGS. 7A-7B) may couple to the arch in a similar manner.

As noted previously, panels 60, 62, 64 of the divider wall 50 may couple to panels of the arch via threaded inserts 41 and threaded couplers 43. The divider wall 50, when coupled in place, may divide an interior volume of the structure 2,3 such that a plurality of rooms are created. Panels 74, 76 may be on a first side of the divider wall system 50, which may define a first room and panels 78, 80 of a second arch of panels may be on a second side of the divider wall system 50, defining a second room of the structure.

The system 50 can have a plurality of doors, including left door 52 and right door 54 which can be used to access volumes divided by the system 50. A door frame 68 may provide support for the doors 52, 54. The top divider wall panels 62, left divider wall panels 56 and right divider wall panels 64 each can have gasketed edges where a gasket 33 is positioned, to form a complete or partial seal between a surface of the divider wall system and interior panel surfaces of panels of the structure 2, 3 (as with the seal formed by gaskets 33 between exterior surfaces of panels of the structure 2, 3 and panels of the side entry element 12, described above).

The top divider wall panels 62, left divider wall panels 56 and right divider wall panels 64 can each be folded onto one another via attached hinges and stacked to form a divider wall stack 70. The divider wall stack 70 can be placed into a pallet 11 for transportation. This may be performed for as many divider walls 50 as desired.

The foregoing description illustrates and describes the processes, machines, manufactures, compositions of matter, and other teachings of the present disclosure. Additionally, the disclosure shows and describes only certain embodiments of the processes, machines, manufactures, compositions of matter, and other teachings disclosed, but it is to be understood that the teachings of the present disclosure are capable of use in various other combinations, modifications, and environments and is capable of changes or modifications within the scope of the teachings as expressed herein, commensurate with the skill and/or knowledge of a person having ordinary skill in the relevant art. The embodiments described hereinabove are further intended to explain certain best modes known of practicing the processes, machines, manufactures, compositions of matter, and other teachings of the present disclosure and to enable others skilled in the art to utilize the teachings of the present disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. Any section headings herein are provided only for consistency with the suggestions or otherwise to provide organizational queues. These headings shall not limit or characterize the invention(s) set forth herein.

What is claimed is:

1. A system, comprising:

a first arch of a first collapsible shelter comprising a first plurality of hinges coupled to a first plurality of panels and a second plurality of panels, wherein each hinge of the first plurality of hinges is coupled to a panel of each of the first plurality of panels and the second plurality of panels, and wherein the first arch is formed when the first collapsible shelter is in an erected state;

a second arch of a second collapsible shelter comprising a second plurality of hinges coupled to a third plurality of panels and a fourth plurality of panels, wherein each hinge of the second plurality of hinges is coupled to a respective panel of each of the third plurality of panels and the fourth plurality of panels, and wherein the second arch is formed when the second collapsible shelter is in an erected state; and a cross-tunnel positioned between the first arch and the second arch, wherein the cross-tunnel comprises a first side-entry element, a cross tunnel arch, and a second side-entry element wherein each of a first panel and a second panel of first plurality of panels has a breakout boundary; wherein each of a first panel and a second panel of the second plurality of panels has a breakout boundary; wherein each of a first panel and a second panel of third plurality of panels has a breakout boundary; and wherein each of a first panel and a second panel of fourth plurality of panels has a breakout boundary, wherein a portion of each panel having the breakout boundary is configured to be removed from the rest of the panel along its respective breakout boundary without removal of adjacent panels and while the first and second arches remain erected to defines an access region to the cross-tunnel, wherein the breakout boundary includes a structure configured to facilitate removal of the portion of each panel having the breakout boundary.

2. The system of claim 1, wherein the first side-entry element comprises first and second side connector panels and a first panel top positioned on a top side of each of the first and second side connector panels, and further wherein each of the first side connector panel and second side connector panel has a gasket positioned on an edge between it and either the first arch or the second arch.

3. The system of claim 1, wherein the cross-tunnel is coupled to the first arch and the second arch via one or more of: a latch; a threaded insert and threaded fastener; a hinge; and an adhesive.

4. The system of claim 1, wherein the structure configured to facilitate removal of the portion of each panel having the breakout boundary is perforations.

5. The system of claim 1, wherein the cross-tunnel comprises a door.

6. The system of claim 1, wherein at least one gasket is positioned on one or more surfaces of panels of the cross-tunnel.

7. The system of claim 1, wherein the cross-tunnel further comprises third and fourth side connector panels and a second panel top positioned on a top side of each of the third and fourth side connector panels.

8. The system of claim 7, wherein the cross-tunnel further comprises a third plurality of hinges coupled to a fifth plurality of panels and a sixth plurality of panels, wherein the fifth plurality of panels and sixth plurality of panels comprise the first and second side connector panels and first panel top, wherein each hinge of the third plurality of hinges is coupled to a respective panel of each of the fifth plurality of panels and the sixth plurality of panels, and wherein a third arch is formed when the complexing element is in an erected state.

9. The system of claim 1, wherein one or more of the breakout boundaries are located within a boundary defined at least by locations where first and second side connector panels and a first panel top of the cross-tunnel are in contact with the first arch.

10. A system, comprising:

an arch of a collapsible shelter comprising a first plurality of hinges coupled to a first plurality of panels and a second plurality of panels, wherein each hinge of the first plurality of hinges is coupled to a panel of each of the first plurality of panels and the second plurality of panels, and wherein the arch is formed when the collapsible shelter is in an erected state; and a side-entry element coupled to the arch, wherein the side-entry element comprises first and second side connector panels and a panel top positioned on a top side of each of the first and second side connector panels, wherein each of a first panel and a second panel of first plurality of panels has a breakout boundary, wherein each of a first panel and second panel of the second plurality of panels has a breakout boundary, wherein a portion of each panel having the breakout boundary is configured to be removed from the rest of the panel along its respective breakout boundary without removal of adjacent panels and while the arch remains erected to define an access region to the side-entry element, wherein the breakout boundary includes a structure configured to facilitate removal of the portion of each panel having the breakout boundary.

11. The system of claim 10, further comprising a cross tunnel arch, and further wherein each of the first side connector panel and second side connector panel has a gasket positioned on an edge between it and the arch.

12. The system of claim 10, wherein the side-entry element is coupled to the arch via one or more of: a latch; a threaded insert and threaded fastener; a hinge; and an adhesive.

13. The system of claim 10, wherein the structure configured to facilitate removal of the portion of each panel having the breakout boundary is perforations.

14. The system of claim 10, wherein at least one gasket is positioned on one or more surfaces of panels of the side-entry element.

15. The system of claim 10, wherein the side-entry element further comprises third and fourth side connector panels and a second panel top positioned on a top side of each of the third and fourth side connector panels.

16. The system of claim 15, wherein the side-entry element further comprises a third plurality of hinges coupled to a fifth plurality of panels and a sixth plurality of panels, wherein the fifth plurality of panels and sixth plurality of panels comprise the first and second side connector panels and first panel top, wherein each hinge of the third plurality of hinges is coupled to a respective panel of each of the fifth plurality of panels and the sixth plurality of panels.

17. The system of claim 10, wherein one or more of the breakout boundaries are located within a boundary defined at least by locations where the first and second side connector panels and a first panel top are in contact with the arch.

* * * * *